United States Patent [19]

Eggert, Jr.

[11] 4,211,173

[45] Jul. 8, 1980

[54] END CONSTRUCTION FOR A RAILWAY CAR

[75] Inventor: Walter S. Eggert, Jr., Huntington Valley, Pa.

[73] Assignee: The Budd Company, Troy, Mich.

[21] Appl. No.: 869,759

[22] Filed: Jan. 16, 1978

[51] Int. Cl.[2] ..... B61D 17/06

[52] U.S. Cl. ..... 105/402; 213/222; 105/421

[58] Field of Search ..... 105/8, 10, 16, 21, 402, 105/403, 425, 458; 213/220, 222

[56] References Cited

U.S. PATENT DOCUMENTS

| | | | |
|---|---|---|---|
| 2,257,084 | 9/1941 | Dean | 105/402 |
| 2,468,591 | 4/1949 | Dean | 105/402 |
| 3,911,833 | 10/1975 | Bauer | 105/402 |

*Primary Examiner*—Trygve M. Blix
*Assistant Examiner*—Frank F. Atwood
*Attorney, Agent, or Firm*—A. L. Trueax, Jr.

[57] ABSTRACT

A pair of collision posts are connected at the end of a railway car between the roof structure and buffer sill. Each of the posts includes a tubular structure formed by welding two elongated "S" shaped strips to an elongated flat strip. Each of the tubular structures fits over and is welded to a hollow anchor member having an enclosed portion towards the bottom fixed to the buffer sill and a tapered upper portion open on one side.

6 Claims, 5 Drawing Figures

FIG. 1
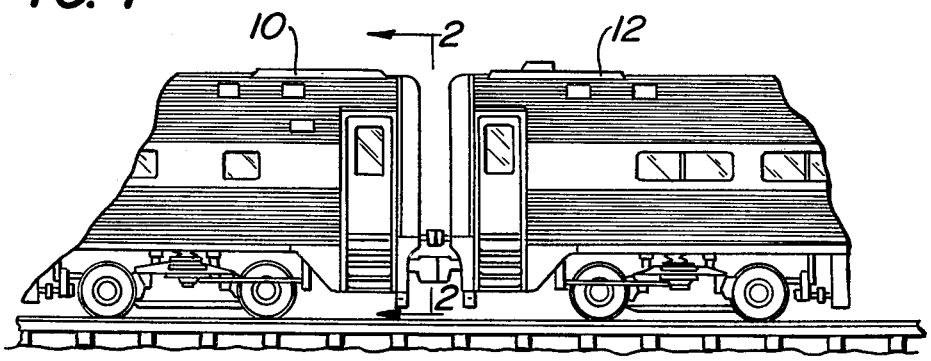
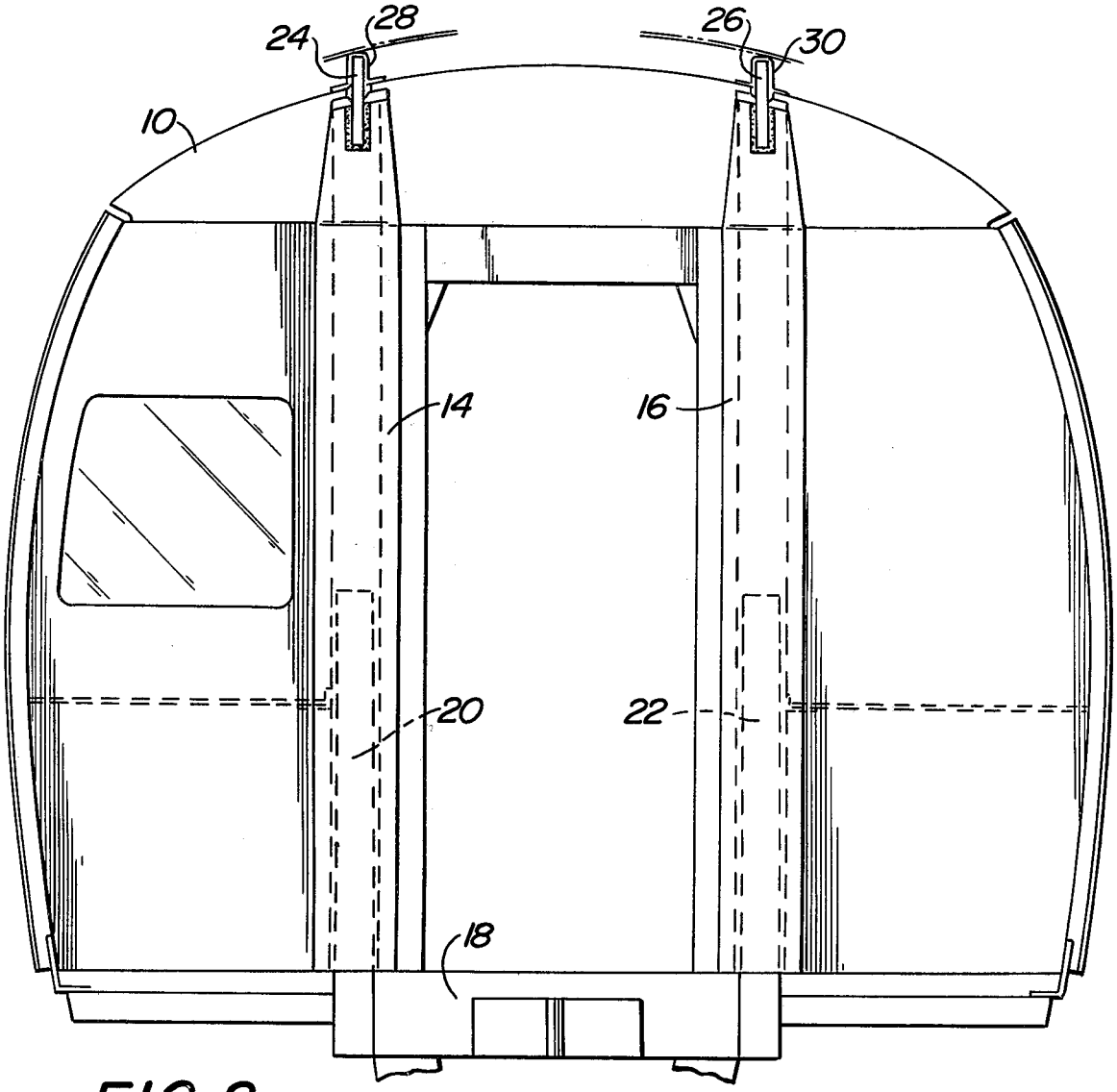
FIG. 2

END CONSTRUCTION FOR A RAILWAY CAR

This application relates to a collision post in a railway car of the general type described in a U.S. Pat. No. to Bauer 3,911,833 entitled "Rail Car End Construction".

The patent to Bauer describes generally some of the problems involved when angular loads are applied to a collision post. This patent solved the problems involved by adding elements to reinforce the posts and by adding a pair of lateral outrigger arms between the posts and the corner posts elevated as high as the critical distance to resist bending loads.

While the aforementioned arrangement has proven satisfactory in many respects, it has the disadvantage that the outrigger arms are required because of the relatively narrow posts and their associated anchor members. Also, the angles at which loads may be applied are limited and not designed to take excessive side impacts.

In designing modern railway cars, weight is an important consideration with respect to efficiency of operation especially with respect to fuel consumption. Thus, while safety is the prime consideration, due regard must be given to the weight of the parts used in the railway car.

It is an object of this invention to provide an improved collision post in a railway car having relatively high resistance to lateral and angular applied loads and which is relatively light in weight.

It is a further object of this invention to provide an improved collision post in which reinforcement means outside of the posts and their associated anchor members is minimized.

In accordance with the present invention, an end wall structure of a railway car includes a pair of relatively wide vertical tubular collision posts disposed in parallel relationship with respect to each other between the ends of buffer sill and the roof of the car. A pair of top brackets connect the tops of the collision posts to roof beams. A pair of relatively wide anchor members are secured to the buffer sill and extend upwardly therefrom to receive the tubular collision posts. Each of the anchor members include an enclosed hollow bottom portion and a tapered top portion open on one side.

Other objects and advantages of the present invention will be apparent and suggest themselves to those skilled in the art from a reading of the following specification and claims, taken in conjunction with the accompanying drawings, in which:

FIG. 1 is a side view of a pair of railway cars which may incorporate the end structure of the present invention;

FIG. 2 is a view taken along lines 2—2 of FIG. 1;

Figure 3:
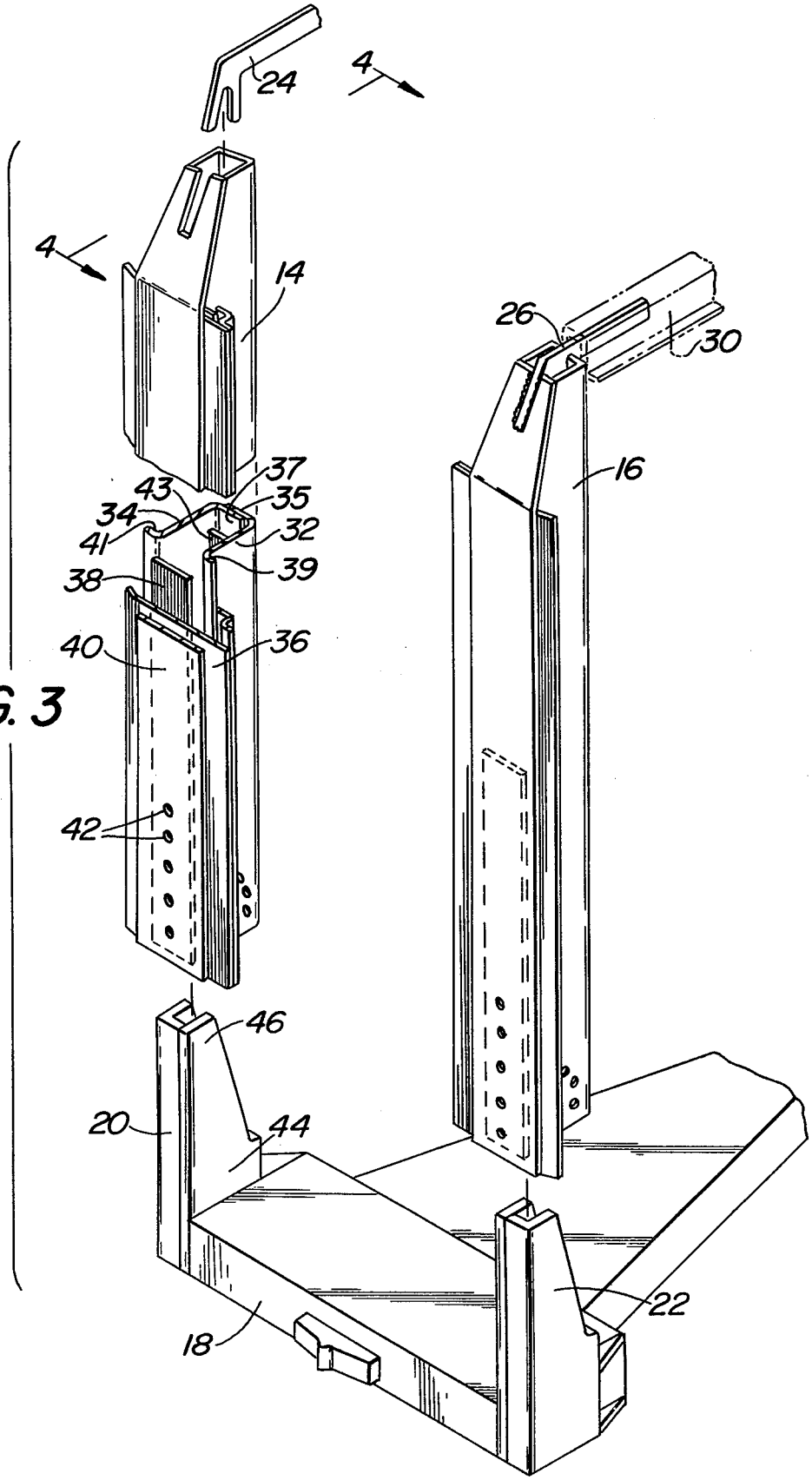
FIG. 3 is an exploded view illustrating detail of the end structure incorporating collision posts, in accordance with the present invention.

Referring to FIG. 1, two railway cars 10 and 12 illustrate a condition wherein it would be possible that a collision could cause damage by the under frame of one car riding up and striking the end wall of the adjacent car above the buffer sill to shear off or bend the end collision posts. In addition to this type of collision, especially if front or single cars are involved, impacts from the front, sides or from an angle often cause the collision posts to bend or collapse.

Referring to FIG. 2, a pair of parallel collision posts 14 and 16 are connected between the buffer sill 18 and roof of the car 10. The collision posts 14 and 16 comprise hollow structures disposed to receive a pair of bottom anchor members 20 and 22, respectively.

The anchor members 20 and 22 are welded to the buffer sill along their bottom edges. After the collision posts 14 and 16 are in place, they are welded to the anchor members 20 and 22 by means of plug welds through openings 42 (FIG. 3) in the posts. Top brackets 24 and 26 are welded in cooperating slots in the collision posts 14 and 16 and fitted into and welded to roof beams 28 and 30, respectively.

Figure 4:
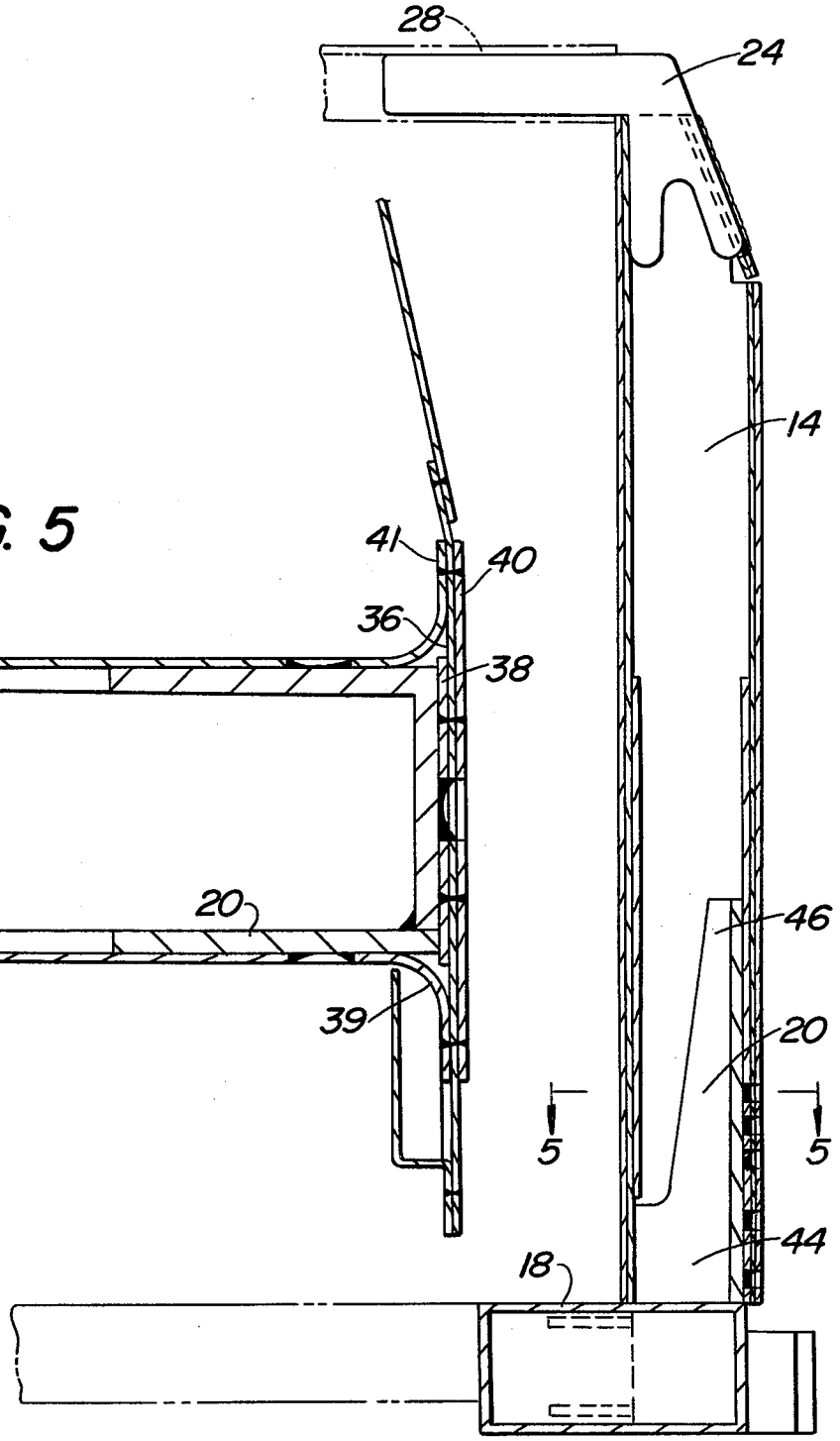
FIG. 4 is a cross sectional view taken along lines 4—4 of FIG. 3.
Figure 5:
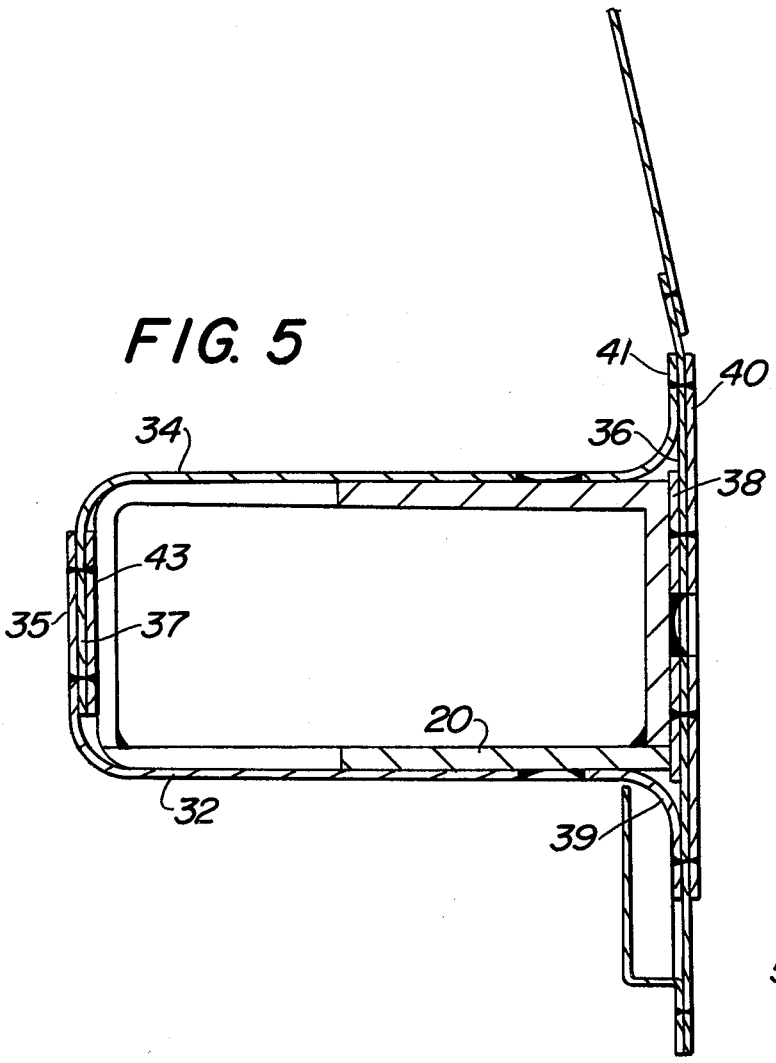
FIG. 5 is a cross sectional view taken along lines 5—5 of FIG. 4.

In connection with FIGS. 3, 4, and 5, because each of the collision posts 14 and 16 and the anchor members 20 and 22 are identical to each other, only the post 14 and anchor members 20 will be described in detail.

The collision post 14 comprises two opposite right angle 2 shaped elongated pieces 32 and 34. The inwardly extending upper arms 35 and 37 of the pieces 32 and 34, respectively, are welded to each other. The other outwardly extended lower arms 39 and 41 of the two pieces 32 and 34, respectively, are welded to a third elongated flat piece 36 which is parallel to the arms 39-41. The three pieces 32, 34 and 36 form a substantially rectangular shaped tubular member.

In welding together 32, 34 and 36, special care must be taken in applying the spot welds to assure that the final assembly is straight. Rolled steel is generally required in the pieces to provide adequate strength. This type of material will tend to expand or contract during spot welding. In forming the posts of the subject invention, the individual welds are maintained at predetermined spacings so as to assure that the final assembly is straight. If properly spaced welds are not applied, one of the pieces involved may expand or contract more than another to cause the overall assembly to be crooked and therefore unacceptable for use as a collision post.

The tubular structure formed by the pieces 32, 34 and 36 is adapted to fit over the relatively heavy anchor member 20 and welded thereto through weld plugs 42. The spacing within the tubular structure, i.e., between the sides of the pieces 32 and 34, is relatively wide. This makes the post 14 especially adapted to receive side impacts without bending. Strips 43 and 38 may be added to the interior towards the bottom of the tubular structure for additional impact resistance, if desired. A front strip 40 is provided to cover the collision post.

The anchor member 20 is relatively thick and wider than anchor members used heretofore. The thicker and wider anchor members provide additional strength and resistance to impacts applied towards the bottom of the collision posts.

The anchor member 20 comprises a relatively wide bottom portion 44 and a tapered upper portion 46. The bottom portion 44 is closed or boxed in and includes four sides. This feature provides additional strength towards the bottom of the anchor member which is welded to the buffer sill. The added area towards the bottom provides increased resistance to impacts or collisions at the area where it is most needed.

The upper portion 46 is tapered and does not offer the same resistance as the bottom portion 44. The reason for this is that it is desirable to provide some degree of bending of the post when severe impacts are encountered. Excessive stiffness throughout the entire length of the post is generally not desirable.

In addition to providing the desired resistances to impacts at the required areas, the anchor member 20 is especially adapted to receive side impacts due to its relative wideness. This eliminates the need for side beams. Also, the fact that the anchor member is relatively hollow, being closed in on four sides towards the bottom and three sides towards its bottom, makes it possible to provide suitable anchoring of the collision post utilizing a minimum amount of weight.

The present invention involving a relatively wide hollow post in combination with a wide hollow anchor member has provided an end structure of high resistance to side loads, while still keeping the parts involved relatively light in weight.

What is claimed is:

1. An end wall structure of a railway car having a buffer sill disposed towards the floor level of said railway car and a plurality of roof beams, comprising:

(a) a pair of vertical tubular posts disposed in parallel relationship with respect to each other between the ends of said buffer sill and said roof beams, (b) a pair of brackets connected to the tops of said posts and to said roof beams, (c) a pair of box anchor members secured to said buffer sill and extending upwardly therefrom to receive the bottom portions of said tubular posts thereabout, (d) said anchor members each having box bottom portions and top tapered portions, (e) said bottom portions secured to said buffer sill being wider than said top portions and formed as opened ended rectangular boxes, and (f) said top portions being tapered channels having three sides extending from said lower portions consisting of one narrow side and the two longer sides and having the longer sides tapering toward the narrow side as they extend upwardly.

2. An end wall structure for a railway car as set forth in claim 1 wherein each of said tubular posts comprise two opposed right angle "Z" shaped elongated strips having upper arms and lower arm area and having said upper arms overlapped and welded to each other longitudinally and having said bottom arms welded longitudinally to a third flat elongated strip parallel to the lower arms thereby forming a tubular post.

3. An end wall structure for a railway car as set forth in claim 2 having the welds of said "Z" shaped pieces and said third piece longitudinally spaced equal distances to maintain the same degree of expansion and contraction.

4. An end wall structure for a railway car as set forth in claim 3 wherein the bottom portions of said tubular posts are welded through plug weld openings to said anchor members.

5. An end wall structure for a railway car as set forth in claim 4 wherein additional reinforcement plates are welded longitudinally from the bottom inside of said tubular posts on the lapped side and opposite side thereon.

6. In a collision post for an end wall structure extending between a roof and a buffer sill of a railway car, a vertically extending rectangular cross-sectioned anchor member for said collision post, said anchor member being secured to said buffer sill and having a lower portion adjacent the buffer sill and an upper portion extending upward from said lower portion, said lower portion and said buffer sill forming an open rectangular box structure, and said upper portion being a tapered channel member consisting of one of the shorter sides of the rectangle and the two adjacent longer sides, said longer sides being tapered toward said shorter side as they extend upwardly from said box structure.

* * * * *